United States Patent [19]

Persson

[11] Patent Number: 4,896,865

[45] Date of Patent: Jan. 30, 1990

[54] FORCE-ABSORBING MEANS IN A FURNACE

[75] Inventor: Hans Persson, Helsingborg, Sweden

[73] Assignee: ASEA Aktiebolag, Västerås, Sweden

[21] Appl. No.: 41,715

[22] Filed: Apr. 23, 1987

[30] Foreign Application Priority Data

May 2, 1986 [SE] Sweden ..... 8602040

[51] Int. Cl.[4] ..... C21B 9/10

[52] U.S. Cl. ..... 266/285; 266/287; 266/197

[58] Field of Search ..... 266/287, 285, 286, 280, 266/242, 197, 275

[56] References Cited

U.S. PATENT DOCUMENTS

| | | | |
|---|---|---|---|
| 1,937,940 | 12/1933 | Boynton | 266/286 |
| 2,134,785 | 11/1938 | Goldberg et al. | 266/275 |
| 2,525,882 | 10/1950 | Ferguson | 266/242 |

FOREIGN PATENT DOCUMENTS

| | | | |
|---|---|---|---|
| 0327000 | 3/1972 | U.S.S.R. | 266/286 |

*Primary Examiner*—S. Kastler

*Attorney, Agent, or Firm*—Kenyon & Kenyon

[57] ABSTRACT

Expansive forces in a furnace of cylindrical shape (e.g. a ladle furnace) are absorbed by means of a metallic ring positioned in the bottom of the furnace which substantially fits the inner, lower side wall of the cylindrical steel shell of the furnace and absorbs the expansive forces directed against this side wall.

3 Claims, 1 Drawing Sheet

FORCE-ABSORBING MEANS IN A FURNACE

TECHNICAL FIELD

The present invention relates to means for absorbing expansive forces in furnace vessels, in particular a ladle furnace or other furnace of cylindrical shape.

The refractory lining material exployed in the bottom of a furnace vessel, for example silicon oxide or aluminum oxide, which is used for, for example, refining steel, expands as the temperature increases. This expansion gives rise to a force directed outwardly against the surrounding steel casing or shell of the furnace. The shell therefore has to be dimensioned to take account of these forces and, in addition, the weight of the melt in the furnace and its lining. This problem is especially pronounced in ladle furnaces and other furnances of cylindrical design.

SUMMARY OF THE INVENTION

The invention aims to provide means to absorb the above-mentioned expansion forces and thus to solve the problems associated therewith and is characterized in that a metallic ring is positioned in the bottom of the furnace, this metallic ring substantially fitting the inner, lower side wall or walls of the steel shell of the furnace and being adapted to absorb the expansive forces directed against these side walls.

This ring can be dimensioned to absorb any expansive forces arising, and therefore there will be no need to increase the thickness of the shell in this lower portion, which is normally necessary in the case of a conventional type of furnace of the type specified above. In addition, there is no need to provide special welds between known prior art thicker lower portions and the rest of the furnace shell, which welds entail an increase production cost and introduce a possible weakened region in the construction of the furnace shell.

In a preferred embodiment of furnace according to the invention, the shell is made with a side shell of uniform thickness, inside which the ring is positioned. The space, if any, between the ring and the shell can be at least partially filled with a force-absorbing material, such as pieces of thin sheet metal etc., to facilitate absorbing the expansive forces.

BRIEF DESCRIPTION OF THE DRAWINGS

The invention will be exemplified in greater detail, by way of example, with reference to the accompanying drawings, wherein.

DESCRIPTION OF CONVENTIONAL FURNACE DESIGN

Figure 1:
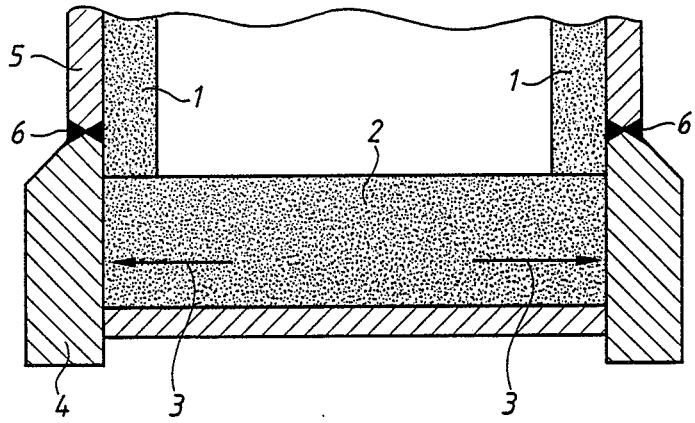
FIG. 1 shows a conventional construction of the bottom end of a cylindrical furnace vessel.

FIG. 1 shows the lower end of a cylindrical furnace vessel of a conventional type, lined with layers 1, 2 of refractory lining compound. Upon increasing temperature, in use of the furnace, the layers of lining compound expand, especially in the lower layer 2. This expansion results in outwardly-directed expansive forces (shown by arrows 3) directed against the shell 4, 5 surrounding the layers 1, 2. The furnace could be a ladle furnace of some other design of cylindrical furnace. To absorb these forces, it has been known to weld a thicker portion 4 to the lower end of the furnace shell 5. This entails an increase in the manufacturing cost of the furnace and also requires a relatively expensive weld 6, which may also constitute a weak spot in the furnace. In addition, the weight of the furnace will be increased because of this extra constructional part.

DESCRIPTION OF PREFERRED EMBODIMENT OF THE INVENTION

Figure 2:
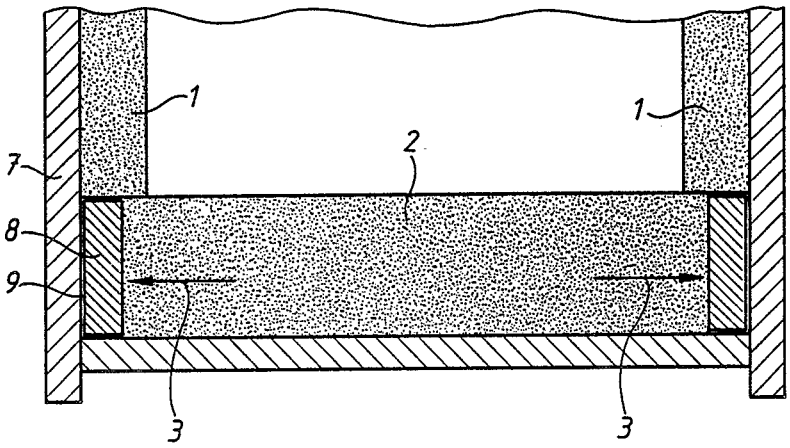
FIG. 2 shows a construction of the bottom end of the furnace according to the invention.

FIG. 2 shows the lower part of a cylindrical furnace (e.g. ladle furnace) according to the invention, which is lined with layers 1, 2 of refractory lining compound. In this case, the layers of lining compound will again expand on temperature rise especially in the lower portion of the furnace and the expansive forces are again shown by the arrows 3. However, a metallic ring 8 is now positioned between the layer 2 of lining compound and the surrounding shell 7 of the furnace. The ring 8 is suitably made from the same material as that of the shell and will take up the expansive forces 3. By filling space 9 left between the shell 7 and the ring 8 with a suitable pressure-absorbing material, for example thin sheet material, the shell 7 and the ring 8 are able to cooperate to absorb the expansive forces 3. The invention can be used to advantage in older furnaces, in which major expansive forces may be expected to occur due to, inter alia, replacement of the layers of lining material. The ring 8 may be made of steel, for example ordinary carbon steel or stainless steel, and suitably is constructed from the same material as is used for the furnace shell 7.

The means according to the invention can be varied in many ways within the scope of the following claims.

What is claimed is:

1. A cylindrical furnace vessel comprising a metal shell forming a cylindrical side wall said cylindrical side wall being of uniform thickness throughout its extent and a bottom wall, a metal cylindrical ring having a bottom end loosely positioned on the bottom wall and an outer periphery at least adjacent to the side wall and loose therefrom, and a layer of refractory lining material covering the top of said bottom wall and having a thickness extending vertically for the height of the ring, the lining material when heated expanding radially and contacting and applying radial force to the ring, the ring receiving and restraining the force and preventing it from acting on the side wall.

2. The furnace vessel of claim 1 in which a cylindrical layer of refractory material covers said side wall and has a bottom end positioned on the top end of said ring and a thickness covering said top end and a portion of said material covering said bottom wall.

3. The furnace vessel of claim 1 in which there is a radial space between said ring's outer periphery and said side wall and the space contains pressure-absorbing material so that said ring and the side wall cooperate to absorb said radial force.

* * * * *